US006644615B1

(12) United States Patent
Liu

(10) Patent No.: US 6,644,615 B1
(45) Date of Patent: Nov. 11, 2003

(54) STABILIZED JACK STAND

(75) Inventor: James Liu, Fullerton, CA (US)

(73) Assignee: Larin Corporation, Ontario (CA)

( * ) Notice: Subject to any disclaimer, the term of this patent is extended or adjusted under 35 U.S.C. 154(b) by 0 days.

(21) Appl. No.: 10/189,863

(22) Filed: Jul. 3, 2002

(65) Prior Publication Data

(65)

(51) Int. Cl.[7] ..... B66F 3/00

(52) U.S. Cl. ..... 248/352; 248/346.07; 254/DIG. 1

(58) Field of Search ..... 248/352, 354.6, 248/354.7, 316.4, 154, 346.06, 346.07, 346.03, 519, 346.04, 316.2, 313; D34/31; 254/DIG. 1

(56) References Cited

U.S. PATENT DOCUMENTS

| | | | | | |
|---|---|---|---|---|---|
| 1,350,970 | A | * | 8/1920 | Hutchinson et al. | 248/346.03 |
| 1,684,925 | A | * | 9/1928 | Perlmutter | 248/346.07 |
| 1,942,945 | A | | 1/1934 | Smith | 254/91 |
| 2,208,983 | A | | 7/1940 | Jackson et al. | 254/91 |
| 2,777,538 | A | | 1/1957 | Cochin | 187/219 |
| 2,880,951 | A | * | 4/1959 | Springer | 248/131 |
| 2,949,978 | A | | 8/1960 | Halstead | 187/219 |
| 3,117,765 | A | | 1/1964 | Chiuzzi | 254/10 C |
| 3,178,146 | A | * | 4/1965 | Goodale | 248/352 |
| 3,317,004 | A | | 5/1967 | Harrison, Jr. | 254/91 |
| 3,330,381 | A | | 7/1967 | Halstead | 254/91 |
| 3,709,330 | A | | 1/1973 | Wells et al. | 254/93 L |
| 3,844,421 | A | | 10/1974 | Nielsen | 414/678 |
| 3,865,214 | A | | 2/1975 | Clark et al. | 254/91 |
| 4,118,002 | A | * | 10/1978 | Bartlett | 248/311.2 |
| 4,447,042 | A | | 5/1984 | Masui | 254/90 |
| 4,520,649 | A | * | 6/1985 | Barton, Sr. | 72/457 |
| 4,573,552 | A | | 3/1986 | Aoki | 254/91 |
| 4,577,821 | A | | 3/1986 | Edmo et al. | 108/145 |
| 4,613,122 | A | | 9/1986 | Manabe | 5/601 |
| 4,712,653 | A | | 12/1987 | Franklin et al. | 187/269 |
| 4,724,930 | A | | 2/1988 | VanLierop | 187/204 |
| 4,753,419 | A | | 6/1988 | Johansson | 254/122 |
| 4,798,266 | A | | 1/1989 | Finkbeiner | 187/211 |
| 4,804,068 | A | | 2/1989 | Carter | 187/210 |
| 4,848,732 | A | | 7/1989 | Rossato | 254/90 |
| 4,858,888 | A | | 8/1989 | Cruz | 254/122 |
| 4,899,987 | A | | 2/1990 | Craig | 254/122 |
| 4,901,980 | A | | 2/1990 | Hansen | 254/9 C |
| 5,016,858 | A | | 5/1991 | Mitchell | 254/45 |
| 5,025,892 | A | | 6/1991 | Stelzl | 187/210 |
| 5,031,726 | A | | 7/1991 | Wakamiya | 187/204 |
| 5,040,637 | A | | 8/1991 | Hawk | 187/206 |
| 5,050,844 | A | | 9/1991 | Hawk | 254/89 H |
| 5,156,238 | A | | 10/1992 | Matthews | 187/243 |
| 5,180,131 | A | * | 1/1993 | Few | 248/352 |
| 5,211,265 | A | | 5/1993 | Gregg | 187/209 |
| 5,322,143 | A | | 6/1994 | Curran | 187/211 |

(List continued on next page.)

OTHER PUBLICATIONS

Wizard Auto Website, http://web.archive.org/web/20000830081801/http://home.att.net/~wizardauto/watj.htm, Aug. 30, 2000.*

*Primary Examiner*—Ramon O. Ramirez
*Assistant Examiner*—Jon Szumny
(74) *Attorney, Agent, or Firm*—Charles Berman; Margo Maddux; Greenburg Traurig LLP

(57) ABSTRACT

A stabilized jack stand for a vehicle comprises a vertically directed leg for location on a foot, and an extendable portion for supporting a vehicle chassis, the leg defining a peripheral area relative to the foot plate. An engagement element releasably secures the foot to the leg, and the foot extends to an area beyond the periphery area of the leg. The leg a side profile extends from a wider portion adjacent to the foot to a narrower portion towards the extendable portion of the jack stand, and the leg has a cross-sectional profile including at least two inter-engaging walls and the engagement element being for interfacing with the two walls.

21 Claims, 2 Drawing Sheets

U.S. PATENT DOCUMENTS

| | | | | | |
|---|---|---|---|---|---|
| 5,340,082 | A | | 8/1994 | Holloway | 254/88 |
| 5,377,782 | A | | 1/1995 | Francis et al. | 187/219 |
| 5,394,959 | A | | 3/1995 | Cullity | 187/244 |
| 5,397,209 | A | | 3/1995 | Heim | 414/349 |
| 5,398,898 | A | * | 3/1995 | Bever | 248/153 |
| 5,429,210 | A | | 7/1995 | Hansen | 187/243 |
| 5,454,625 | A | | 10/1995 | Christensen et al. | 298/18 |
| 5,460,460 | A | | 10/1995 | Alexander | 14/71.3 |
| D378,155 | S | | 2/1997 | Bartow et al. | D34/28 |
| 5,613,575 | A | | 3/1997 | Ackermann | 187/211 |
| 5,636,711 | A | | 6/1997 | Nussbaum | 187/211 |
| 5,695,173 | A | | 12/1997 | Ochoa et al. | 254/122 |
| 5,727,655 | A | | 3/1998 | Pitman | 187/211 |
| 5,743,505 | A | * | 4/1998 | Sofy | 248/346.01 |
| 5,829,948 | A | | 11/1998 | Becklund | 414/607 |
| 5,915,672 | A | * | 6/1999 | Dickey | 254/133 R |
| 5,934,414 | A | | 8/1999 | Staczek | 187/269 |
| 5,967,494 | A | | 10/1999 | Florese | 254/122 |
| 6,070,699 | A | | 6/2000 | Bleeker | 187/240 |
| 6,112,858 | A | | 9/2000 | Arnst | 187/269 |
| 6,182,796 | B1 | | 2/2001 | Perlstein et al. | 187/208 |
| 6,186,279 | B1 | | 2/2001 | Blocker et al. | 187/206 |
| 6,193,078 | B1 | | 2/2001 | Stuhlmacher | 211/20 |
| 6,206,346 | B1 | | 3/2001 | Johnson et al. | 254/88 |
| 6,227,513 | B1 | * | 5/2001 | Richard | 248/346.07 |
| 6,257,372 | B1 | | 7/2001 | Schirmer | 187/269 |
| 6,338,470 | B1 | | 1/2002 | Steely et al. | 254/124 |
| 6,345,693 | B1 | | 2/2002 | Yeo et al. | 187/211 |
| 6,364,060 | B1 | | 4/2002 | Cherry | 187/203 |
| 6,375,134 | B1 | * | 4/2002 | Goldschmidt et al. | 248/154 |
| 6,443,413 | B1 | * | 9/2002 | Hawkins et al. | 248/352 |

* cited by examiner

STABILIZED JACK STAND

BACKGROUND OF THE INVENTION

1. Field of the Invention

This invention relates to stabilized jack stands. In particular, it relates to a system for stabilizing a jack stand for raising a motor vehicle.

Difficulties arise in using jack stands to support a vehicle which has been raised for maintenance purposes or other work. Sometimes the vehicle may be moved inadvertently and the jack stand structure is not sufficiently stabilized to prevent tipping. This can result in dangerous consequences, such as the entire motor vehicle falling to the ground and this can cause injury or worse to persons close by the raised vehicle.

There is a need to provide a system and method for stabilizing jack stands and other devices in a manner which would more likely prevent unauthorized, unintended tipping of the jack stand rom a vertical position in which it is supporting a vehicle or the like.

SUMMARY

2. General Background and State of the Art

According to the invention, there is provided a stabilizer for a vehicle jack stand. The jack stand includes at least one vertically directed leg for location on a foot or base. There is an extendible portion for supporting a vehicle chassis. The leg defines a peripheral area relative to the foot. There is also provided an engagement element which is separable from the leg, and which is for adjustably securing the foot to the leg. The engagement element extends to an area beyond the peripheral area of the leg.

In a preferred form of the invention, the foot is a plate for location on the side of the leg opposite to the portion that is for supporting the vehicle or the like.

The leg preferably has a side profile extending from a wider portion adjacent to the foot and a narrower portion toward the extendable portion of the jack stand. The cross-sectional profile of the leg when viewed from below, namely from the location adjacent to the foot, includes at least two inter-engaging walls and the engagement element interfaces with the two walls. Preferably there are at least four inter-engaging walls defining four corners and at least four engagement members interfacing with the four corners.

There is adjustment means for locating the separable engagement means, and the adjustment means is capable of location in different selected positions on the foot.

In yet a preferred form of the invention there are slots for receiving a shank of a bolt extending between the engagement means and the foot. A nut for securing the bolt thereby locks the engagement means with the foot in a selected position in this slot.

The foot is preferably cross-sectionally square and the slots extend from a position from the corners of the square towards the center of the foot element.

The invention is now further described with reference to the accompanying drawings which are illustrative only.

DETAILED DESCRIPTION OF THE PREFERRED EMBODIMENTS

Figure 1:
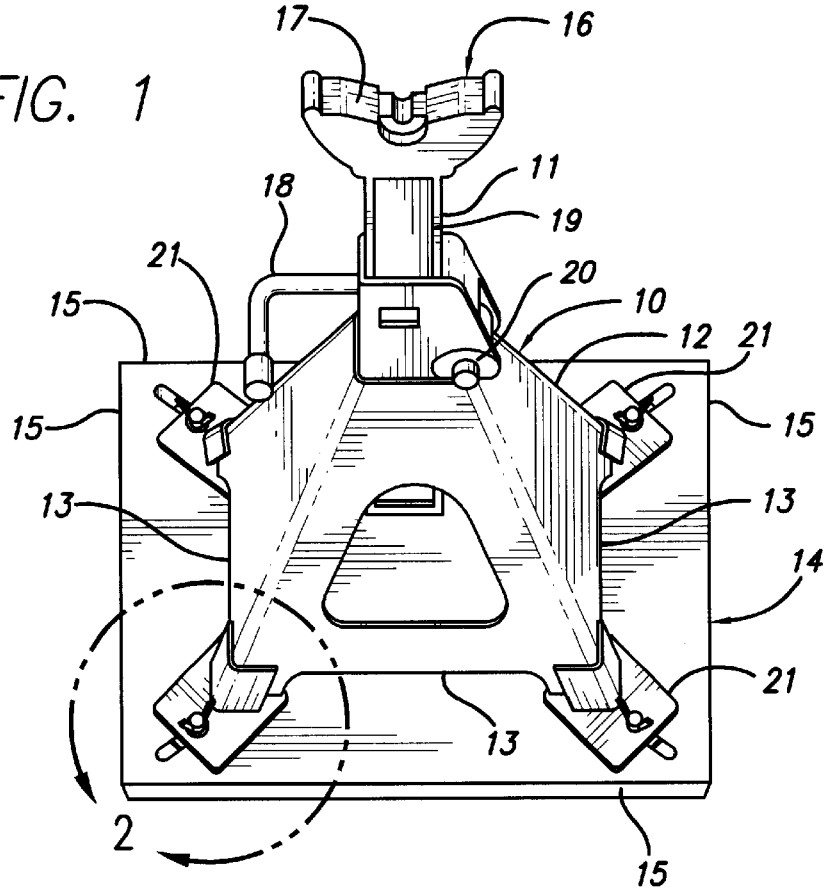
FIG. 1 is a perspective view of the stabilizer for the vehicle jack stand, the perspective view being shown from the top and viewed downwardly.
Figure 2:
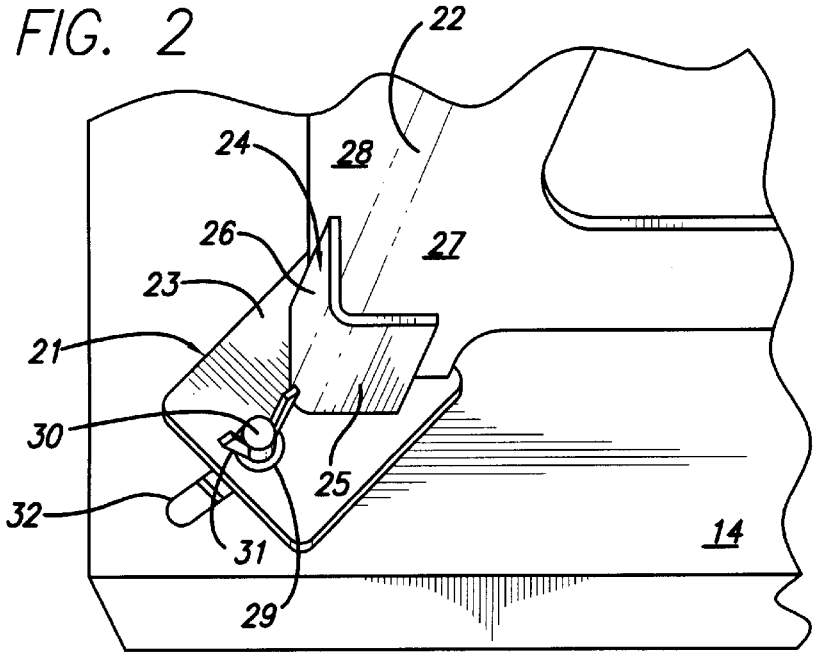
FIG. 2 is an exploded view of one corner of the stabilizer showing the leg and the foot and the engagement means.

A stabilized jack stand comprises at least one vertically directed leg for location on a base, and an extendable portion for supporting a body, the leg defining a peripheral area relative to the base. The base is a foot, and there is at least one movable engagement element for securing the foot to the leg.

The foot extends to an area beyond the periphery area of the leg, and the foot is separable from the leg. The foot is a plate for location on one face with the leg. The leg includes a side profile extending from a wider portion adjacent to the foot to a narrower portion towards the extendable portion of the jack stand. The leg has a cross-sectional profile including at least two inter-engaging walls and the engagement element being for interfacing with the two walls.

The foot plate includes four slots, one slot for each of four respective engagement means, and four bolts and respectively four nuts, one for each engagement means. The slots extend from a position towards the corners of the square foot plate in a direction towards the center of the square. The bolt means permits the engagement means to be secured to the outer extremity of the leg.

The engagement means has a flat base and an upstanding member, the flat base being for moving parallel with a base plate being the foot, and the upstanding members of the engagement members engaging the leg. The leg includes a wall directed at an angle being inwardly from the base towards the central area adjacent to the extendible portion of the jack stand, and the upstanding area of the engagement members being angled to mate with the angle of the wall of the leg.

A stabilizer for a vehicle jack stand 10 includes at least one vertically directed leg 11 which is for location on a base 12. There is an extendible portion of the leg 11 for supporting a vehicle chassis. The leg has a peripheral area 13 which is for location in adjacency with a foot element 14. The peripheral area 13 defines a substantially square cross-sectional profile with each of the sides 13 being substantially equal. The foot element 14 likewise has a substantially square profile with each side 15 being substantially the same length.

The leg 11 at its topmost portion 16 has a support element 17 for securing the component to be raised. This component can be a motor vehicle or other component which needs to be raised. A handle 18 works with a pawl and ratchet mechanism on the side 19 of the leg 11 so that the pawl and ratchet or teeth and slots can be secured together so that the leg 11 can remain in an extended position securely. Moving the handle 18 can release the teeth from slots so that the leg 11 can be distended as necessary. A suitable mechanism for 18 as it rotates about a cross-arm 20 permits the leg to extend or retract as necessary.

There is an engagement element 21 which is for location at each of the corners 22 of the leg 11. The engagement element 21 includes a flat plate 23 and an upstanding angular portion 24. Angular portion includes two sides 25 and 26 which engage with each of walls 27 and 28 respectively of the leg 12. At each of the four corners 22 there is an appropriate engagement element 21 for securing the leg relative to the foot element 14. The flat plate 23 includes an aperture 29 through which a bolt 30 can pass.

A wing nut 31 is secured to the top of the bolt 30. There is a slot 32 in the foot element so that the flat plate 23 can slide from each of the corners 33 of the foot element 14 from the direction of the comers 33 towards the central position 34 in the foot.

Figure 3:
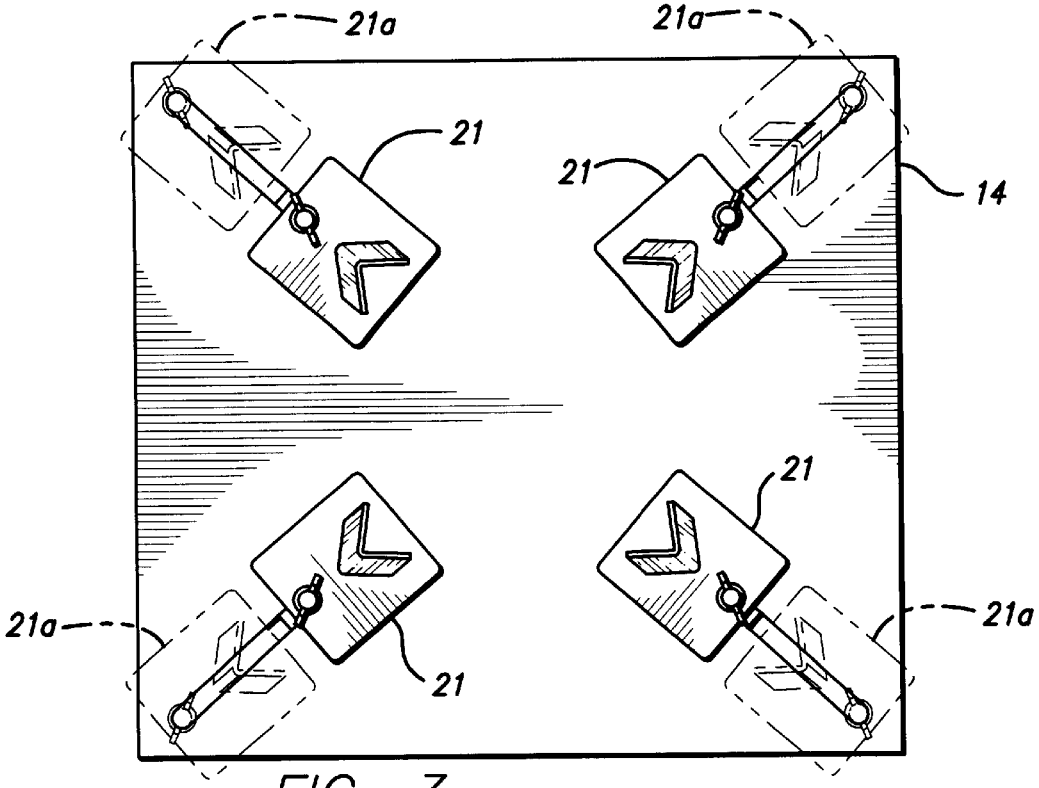
FIG. 3 is a top view of the foot showing the stabilizer means and the engagement means relative to the slots.
Figure 4:
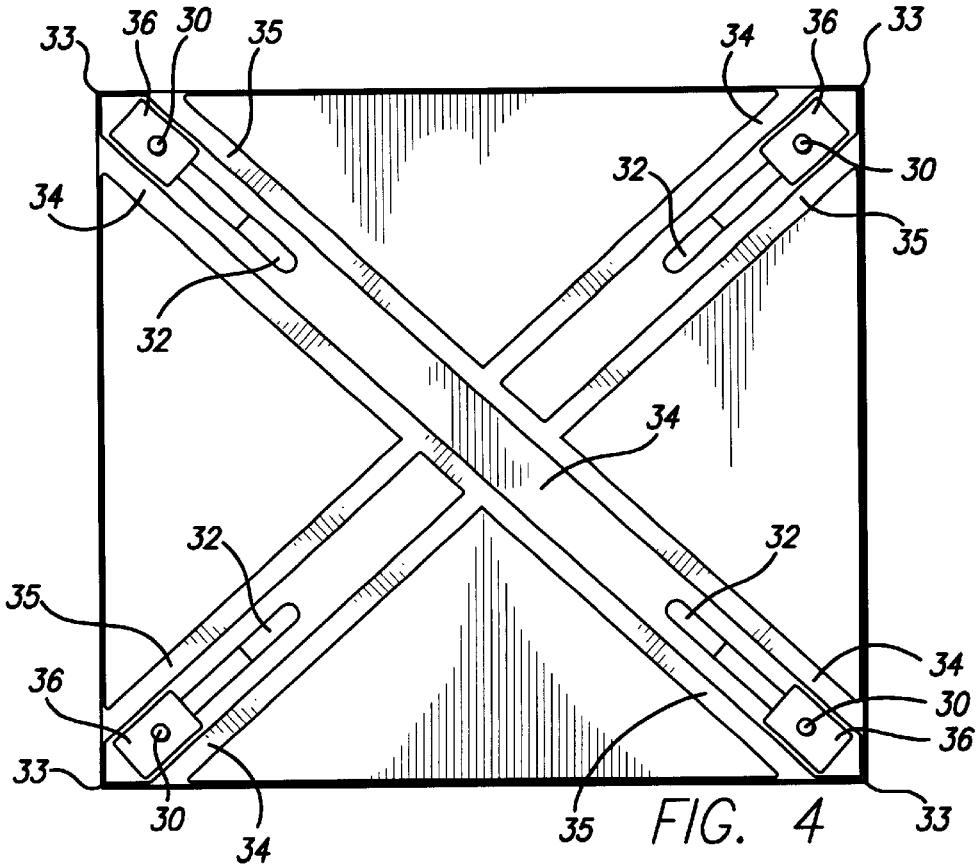
FIG. 4 is an underview of the plate being the foot.

The engagement elements can be located in different positions as shown in FIG. 3. In FIG. 3 the internally located position is shown in solid lines. In the extended position, the elements 21 are shown in the phantom lines 21*a* The release of the leg from the foot plate 14 is achieved by undoing the wingnuts 31 so that the bolts are relatively free to move in the respective slots 32. The engagement element 21 can then be moved rearwardly to position 21*a* and the leg can be removed from the foot plate 14.

To insure the free movement of the bolts 30 and the slots 32, there are raised rail-like elements 34 and 35 which are located on the underside on either side of the slot 32. The head 36 of the bolt 30 is effectively formed by a plate 36 which can ride underneath the slot between the rails 34 and 35. The underneath of the plate 14 is supported on the underportion of each of the rails 34 and 35.

Many other forms of the invention exist, each differing from others in matters of detail only.

For instance, instead of a four cornered profiled base for the leg, there could be other multisided structures for the base. In some instances, the base may also have a circular configuration. In other variations the foot element can have a different profile and can be a rectangular configuration or partly circular or wholly circular as the case may be. Other forms for securing the foot to the leg can be provided.

Other separate means can be defined for securing the foot and leg together. In some instances, the foot is a separable means provided for retrofitting on to a pre-existing leg for a jack stand.

The invention is to be determined solely by the following claims.

I claim:

1. A stabilized jack stand comprising at least one vertically directed leg for location on a base, and an extendable portion for supporting a body, the leg defining a peripheral area relative to the base, the base including a foot, an engagement element for securing the foot to the leg, and the foot extending to an area beyond the peripheral area of the leg, the foot being separable from the leg, and wherein the engagement element has a flat base and an upstanding member, the flat base being for moving parallel with a base plate being the foot, and the upstanding element of the engagement element engaging the leg, and wherein the leg includes a wall directed at an angle being inwardly from the base towards the central member adjacent to the extendible portion of the jack stand, and the upstanding member of the engagment member being angle to mate with the angle of the wall of the leg.

2. The stabilized jack stand as claimed in claim 1 wherein the foot is a plate for location on one face with the leg.

3. The stabilized jack stand as claimed in claim 1 wherein the leg includes a side profile extending from a wider portion adjacent to the foot to a narrower portion towards the extendable portion of the jack stand.

4. The stabilized jack stand as claimed in claim 1 wherein the leg has a cross-sectional profile including at least two inter-engaging walls and the engagement element being for interfacing with the two walls.

5. The stabilized jack stand as claimed in claim 4 wherein the leg includes at least four elements defining four corners and a total of at least four engagement elements interfacing with the four corners.

6. The stabilized jack stand as claimed in claim 1 including adjustment means for locating the engagement element in selected different positions on the foot, and thereby engaging the leg at different selected positions.

7. The stabilized jack stand as claimed in claim 6 wherein the base includes slots for receiving the shank of a bolt extending between the engagement element and the foot, and a nut for securing the bolt thereby locking the engagement element with a foot in a selected position in the slot.

8. The stabilized jack stand as claimed in claim 7 including four slots, one slot for each of a total of at least four respective engagement elements, and four bolts and respectively four nuts, one for each engagement element.

9. The stabilized jack stand as claimed in claim 1 wherein the foot is a plate of a selected cross-sectional area extending beyond the peripheral area defined by the leg.

10. The stabilized jack stand as claimed in claim 9 wherein the cross-sectional area is a square extending beyond a square defined by the leg peripheral area.

11. The stabilized jack stand as claimed in claim 10 including slots extending from a position towards the corners of the square in a direction towards the center of the square.

12. The stabilized jack stand as claimed in claim 1 wherein the foot comprises a base plate, and the engagement element being moveably locatable relative to the plate.

13. The stabilized jack stand as claimed in claim 12 including slots in the plate for permitting anchoring of the engagement element relative to the plate, bolt means extending between one of the slots engagement element.

14. The stabilized jack stand as claimed in claim 13 wherein the bolt means permits the engagement element to be secured to the outer extremity of the leg.

15. A stabilized jack stand for a vehicle comprising at least one vertically directed leg for location on a base, and an extendable portion for supporting a vehicle chassis, the leg defining a peripheral area relative to the base, the base including a foot, for securing the foot to the leg, and the foot extending to an area beyond the periphery area of the leg, wherein the foot is a plate for location on one face with the leg, the leg including a side profile extending from a wider portion adjacent to the foot to a narrower portion towards the extendable portion of the jack stand, and the leg having a cross-sectional profile including at least four corners and one of the engagement elements interfaces with respectively each of the four corners, and the foot includes four slots, one slot for each of the four respective engagement elements, and a bolt and a nut respectively for each engagement element, the engagement elements being locatable in selected different positions on the foot, and thereby engaging the leg at different selected positions, wherein each slot in the foot is for receiving the shank of a respective bolt extending between a respective engagement element and the foot, and each nut is for securing the respective bolt thereby locking the respective engagement elements with the foot in a selected position in the slot, and wherein each engagement element has a flat base and an upstanding members, the flat base being for moving parallel with a base plate being the foot, and the upstanding member of the engagement element engaging the leg, and wherein the leg includes a wall directed at an angle being inwardly from the base towards the central area adjacent to the extendible portion of the jack stand, and the upstanding member of the engagement member being angled to mate with the angle of the wall of the leg.

16. The stabilized jack stand as claimed in claim 15 wherein the foot is a plate of a selected cross-sectional area, the cross-sectional area extending beyond the area defined by the foot cross-sectional area, wherein the slots extend from a position towards the periphery of the cross-sectional area in a direction towards the center.

17. The separable engagement element as claimed in claim 15 wherein the plate is for secure location with the leg, and the leg has a cross-sectional profile including at least two inter-engaging walls and each engagement element being for interfacing with the two walls.

18. A stabilized jack stand for a vehicle comprising at least one vertically directed leg for location on a base, and an extendable portion for supporting a vehicle chassis, the leg defining a peripheral area relative to the base, the base including a foot, at least four engagement elements for securing the foot to the leg, and the foot extending to an area beyond the periphery area of the leg, wherein the foot is a plate for location on one face with the leg, the leg including a side profile extending from a wider portion adjacent to the foot to a narrower portion towards the extendable portion of the jack stand, and the leg having a cross-sectional profile including at least two inter-engaging walls and the engagement element being for interfacing with the two walls, and wherein the leg includes at least four corners and four engagement elements interface with the four corners, and the foot includes four slots, one slot for each of the four respective engagement elements, and four bolts and respectively four nuts, one for each engagement element.

19. The stabilized jack stand as claimed in claim 18 including adjustment means for locating each engagement element in selected different positions on the foot, and thereby engaging the leg at different selected positions, wherein the base includes slots for receiving the shank of a bolt extending between each engagement element and the foot, and a nut for securing the bolt thereby locking the engagement element with a foot in a selected position in the slot.

20. The stabilized jack stand as claimed in claim 18 wherein the foot is a plate of a selected cross-sectional area, the cross-sectional area being a square extending beyond a square defined by the leg peripheral area, including slots extending from a position towards the corners of the square in a direction towards the center of the square.

21. A stabilized jack stand for a vehicle comprising at least one vertically directed leg for location on a base, and an extendable portion for supporting a vehicle chassis, the leg defining a peripheral area relative to the base, the base including a foot, an engagement element for securing the foot to the leg, and the foot extending to an area beyond the periphery area of the leg, wherein the foot is a plate for location on one face with the leg, the leg including a side profile extending from a wider portion adjacent to the foot to a narrower portion towards the extendable portion of the jack stand, and the leg having a cross-sectional profile including at least two inter-engaging walls and the engagement element being for interfacing with the two walls, and wherein the engagement element has a flat base and an upstanding member, the flat base being for moving parallel with a base plate being the foot, and the upstanding member of the engagement element for engaging the leg, and wherein the leg includes a wall directed at an angle being inwardly from the base towards the central area adjacent to the extendible portion of the jack stand, and the upstanding member of the engagement element being angled to mate with the angle of the wall of the leg.

* * * * *